US005293889A

United States Patent [19]

Hall et al.

[11] Patent Number: 5,293,889

[45] Date of Patent: Mar. 15, 1994

[54] BEACH UMBRELLA

[76] Inventors: Terrance A. Hall; Susan A. Hall, both of Pitcher St., Montgomery, Mass. 01085

[21] Appl. No.: 901,569

[22] Filed: Jun. 19, 1992

[51] Int. Cl.[5] ..... A45B 11/00; A45B 25/22

[52] U.S. Cl. ..... 135/16; 135/19; 248/533; 52/152

[58] Field of Search ..... 135/16, 19, 98, 99; 248/530, 533, 548; 52/152

[56] References Cited

U.S. PATENT DOCUMENTS

| | | | |
|---|---|---|---|
| 395,224 | 12/1888 | Hale | 135/66 |
| 3,038,483 | 6/1962 | Altsheler | 135/66 |
| 3,091,249 | 5/1963 | O'Neil | 135/16 |
| 3,444,799 | 5/1969 | Covington | 135/16 |
| 3,692,035 | 10/1972 | Houston | 135/16 |
| 4,229,015 | 10/1980 | Ramsey et al. | 136/66 |
| 4,712,762 | 12/1987 | Liedle | 248/533 |
| 4,832,304 | 5/1989 | Morgulis | 135/16 |
| 4,989,123 | 1/1991 | Best | 135/16 |
| 5,046,699 | 9/1991 | Perreault et al. | 135/66 |
| 5,143,108 | 9/1992 | Kenney | 135/16 |
| 5,161,561 | 11/1992 | Jamieson | 135/16 |

FOREIGN PATENT DOCUMENTS

| | | | |
|---|---|---|---|
| 3111908 | 10/1982 | Fed. Rep. of Germany | 135/66 |
| 1272460 | 4/1972 | United Kingdom | 135/16 |

*Primary Examiner*—Carl D. Friedman
*Assistant Examiner*—Wynn E. Wood
*Attorney, Agent, or Firm*—Leon Gilden

[57] ABSTRACT

A beach umbrella is provided having a lowermost section assembled selectively with an intermediate and upper section, with the upper section including an umbrella canopy mounted thereto. The lowermost section includes a plurality of handles pivotally mounted about an upper collar of the lower section to enhance rotation of the lower section, with the lower section provided with a screw thread directed about a lowermost portion of the lower section to permit projecting of the lowermost section into an underlying beach surface to secure the umbrella in a fixed relationship to the beach. Latch means are arranged to secure the sections together.

4 Claims, 5 Drawing Sheets

BEACH UMBRELLA

BACKGROUND OF THE INVENTION

1. Field of the Invention

The field of invention relates to umbrella structure, and more particularly pertains to a new and improved beach umbrella arranged for fixed securement to a beach surface.

2. Description of the Prior Art

Beach umbrellas of various types have been utilized throughout the prior art and typically, they are subject to prevailing winds and individuals inadvertently contacting the umbrella inducing the umbrella to tip and pivot requiring its repositioning. The instant invention attempts to overcome deficiencies of the prior art by providing for anchoring structure mounted within the beach umbrella to enhance the securement to a beach or an underlying support surface.

The prior art has heretofore failed to direct structure in a manner as set forth by the instant invention to permit securement of a beach umbrella to an underlying beach surface and accordingly there remains a need for a new and improved beach umbrella as set forth by the instant invention addressing both the problems of ease of use as well as effectiveness in construction and in this respect, the present invention substantially fulfills this need.

SUMMARY OF THE INVENTION

In view of the foregoing disadvantages inherent in the known types of beach umbrellas now present in the prior art, the present invention provides a beach umbrella wherein the same is arranged for threaded directing into an underlying support surface. As such, the general purpose of the present invention, which will be described subsequently in greater detail, is to provide a new and improved beach umbrella which has all the advantages of the prior art beach umbrellas and none of the disadvantages.

To attain this, the present invention includes a beach umbrella providing a lowermost section assembled selectively with an intermediate and upper section, with the upper section including an umbrella canopy mounted thereto. The lowermost section includes a plurality of handles pivotally mounted about an upper collar of the lower section to enhance rotation of the lower section, with the lower section provided with a screw thread directed about a lowermost portion of the lower section to permit projecting of the lowermost section into an underlying beach surface to secure the umbrellas in a fixed relationship to the beach. Latch means are arranged to secure the sections together.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved beach umbrella which has all the advantages of the prior art beach umbrella and none of the disadvantages.

It is another object of the present invention to provide a new and improved beach umbrella which may be easily and efficiently manufactured and marketed.

It is a further object of the present invention to provide a new and improved beach umbrella which is of a durable and reliable construction.

An even further object of the present invention is to provide a new and improved beach umbrella which is susceptible of a low cost of manufacture with regard to both materials and labor, and which accordingly is then susceptible of low prices of sale to the consuming public, thereby making such beach umbrellas economically available to the buying public.

Still yet another object of the present invention is to provide a new and improved beach umbrella which provides in the apparatuses and methods of the prior art some of the advantages thereof, while simultaneously overcoming some of the disadvantages normally associated therewith.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
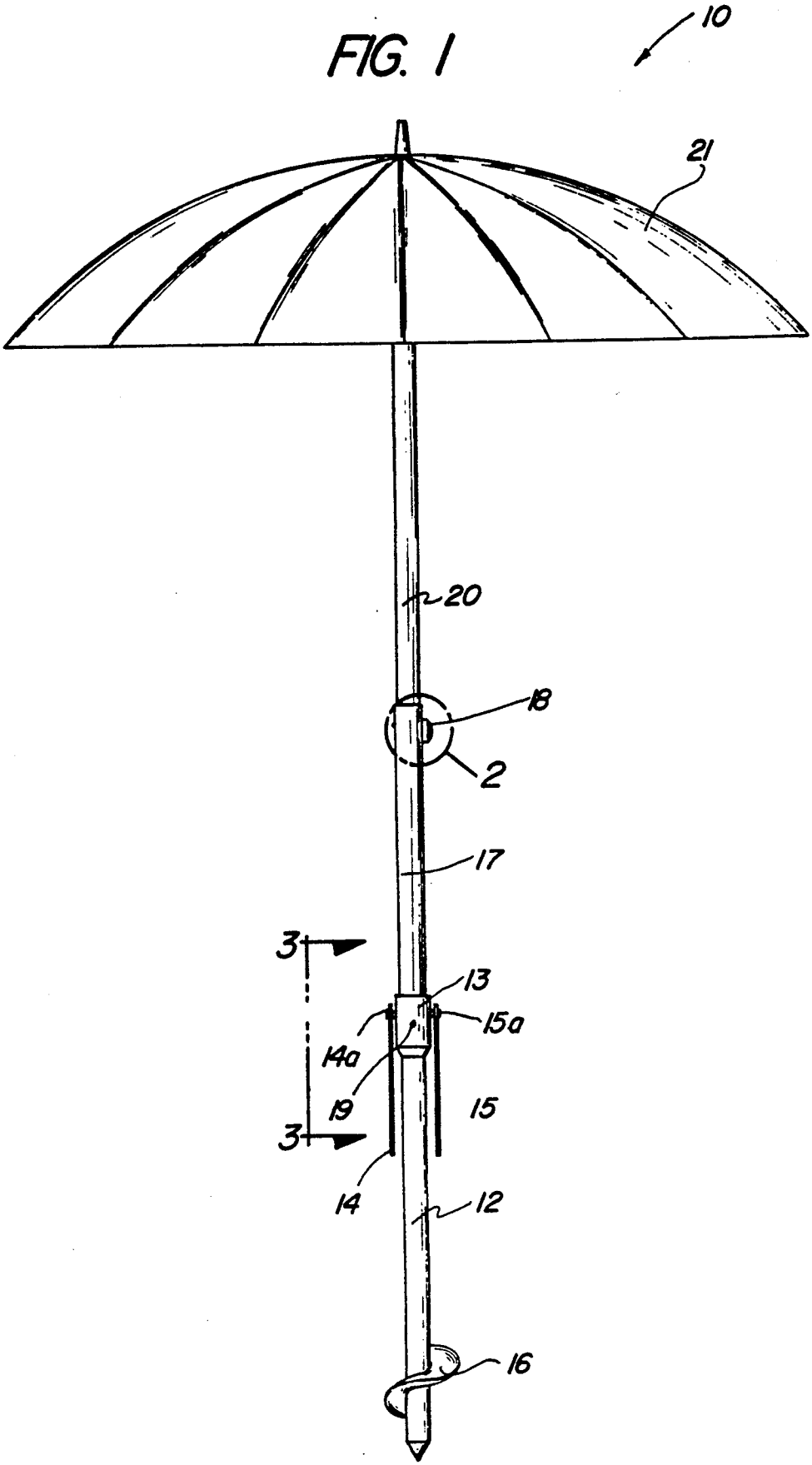
FIG. 1 is an orthographic view of the umbrella of the invention, taken in elevation.
Figure 2:
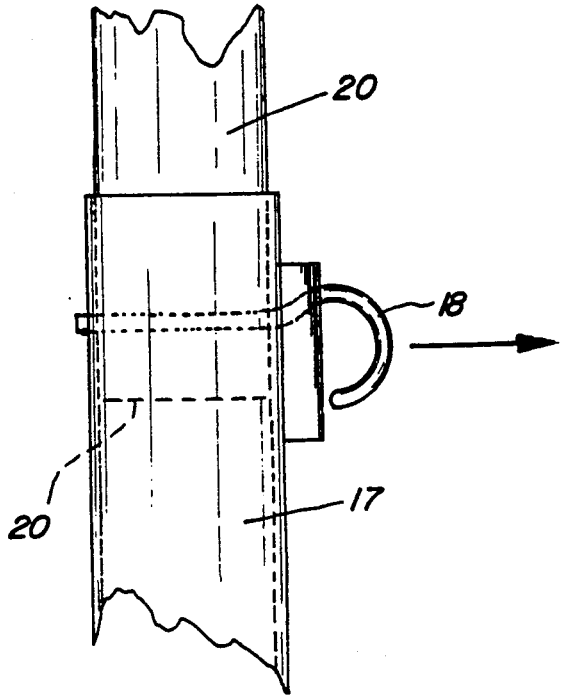
FIG. 2 is an orthographic view, somewhat enlarged, of section 2 as set forth in FIG. 1.
Figure 3:
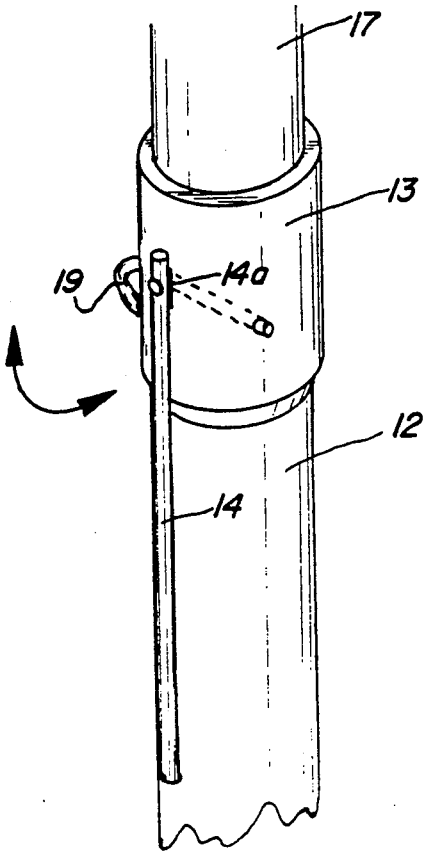
FIG. 3 is an isometric illustration of section 3—3 as set forth in FIG. 1, taken along the lines of the arrows.

With reference now to the drawings, and in particular to FIGS. 1 to 10 thereof, a new and improved beach umbrella embodying the principles and concepts of the present invention and generally designated by the reference numeral 10 will be described.

More specifically, the beach umbrella 10 of the instant invention essentially comprises an umbrella lower shaft 12 having a lower shaft socket 13 at an upper distal end coaxially aligned with the lower shaft 12, and an outer screw thread 16 fixedly mounted about the lower shaft adjacent the lower shaft's lower distal end, with a lower distal end of the lower shaft 12 terminating in a conical projection to enhance ease of projection and positioning of the beach umbrella prior to directing the outer screw threads 16 into an underlying surface, such as beach sand and the like. First and second handles 14 and 15 are pivotally mounted about respective first and second pivot axles 14*a* and 15*a*, with the pivot axles diametrically aligned on opposed sides of the lower shaft socket 13. In this manner, the handles may be lifted to a horizontal orientation from the vertical orientation, as illustrated in the FIG. 1, for enhanced ease of rotation of the umbrella structure relative to an underlying beach surface.

An intermediate shaft 17 is provided and arranged for coaxial mounting and alignment relative to the lower shaft. The intermediate shaft 17 has directed therethrough an upper latch pin 18 (see FIG. 2) directed through the upper shaft and a lower portion of an upper shaft 20 that is received within the intermediate shaft. A lower latch pin 19 is directed through the lower shaft socket 13 and a lower portion of the intermediate shaft 17.

The upper shaft 20 includes an umbrella canopy 21 mounted adjacent an upper portion of the upper shaft for selective collapse and extension in a conventional manner.

Figure 4:
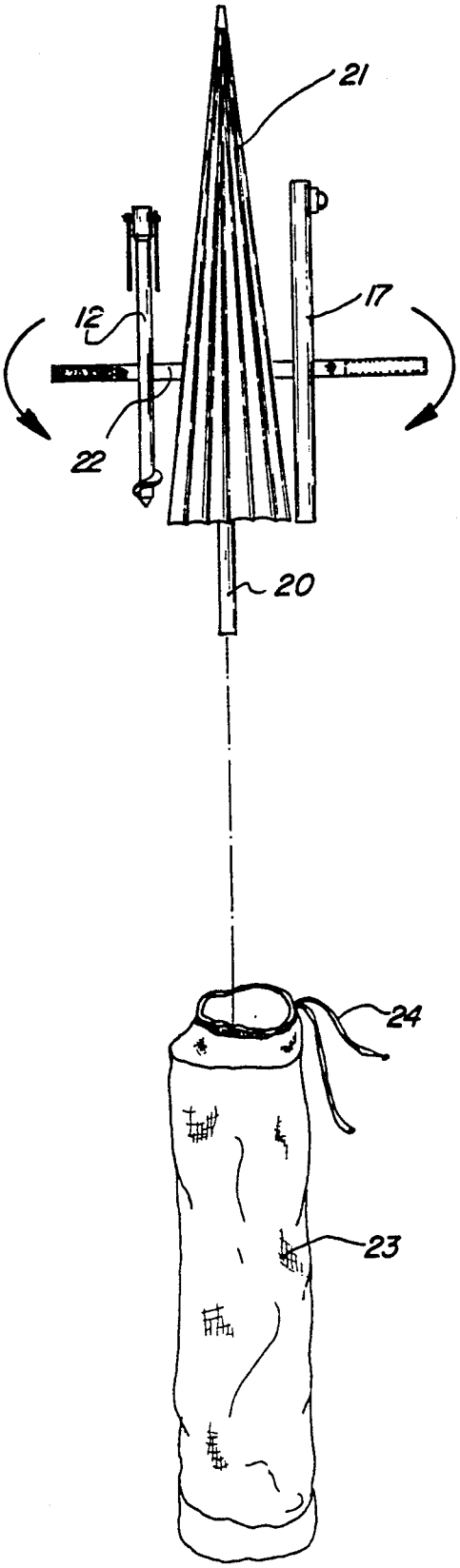
FIG. 4 is an orthographic view of the invention in a disassembled configuration for transport thereof.

Reference to FIG. 4 illustrates the organization arranged for ease of transport and storage, wherein the components are disassembled, with a securement web 22 having hook and loop fastener terminal end portions arranged for the securement of the components with their subsequent positioning within a container bag 23 and a drawstring 24 about a bag entrance opening.

Figure 5:
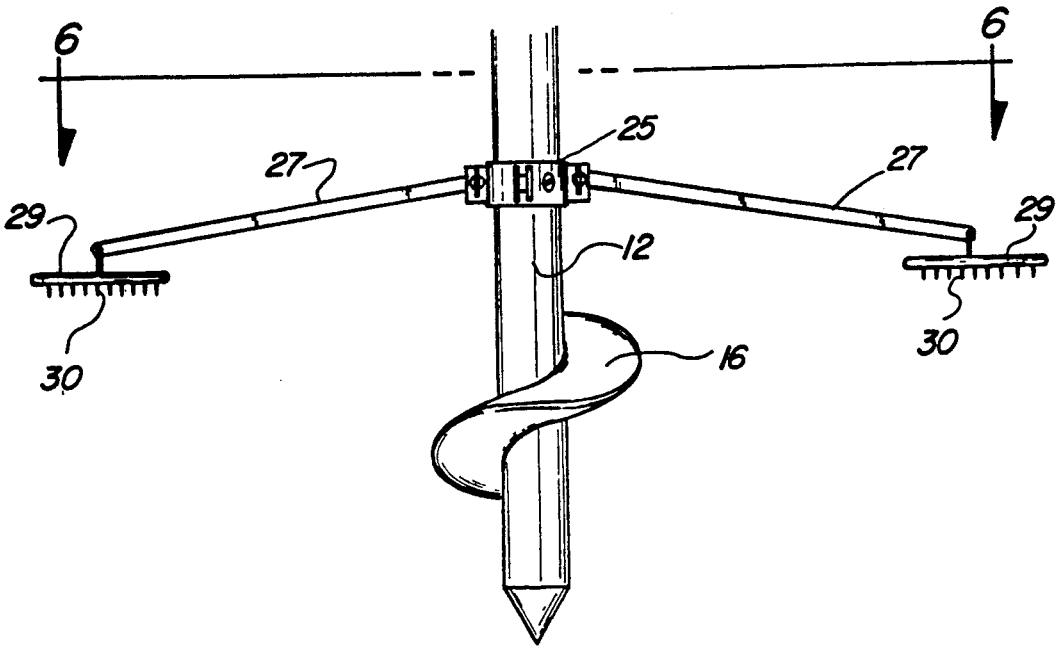
FIG. 5 is an orthographic partial view of the umbrella lower shaft having a stabilizer assembly mounted thereabout.
Figure 6:
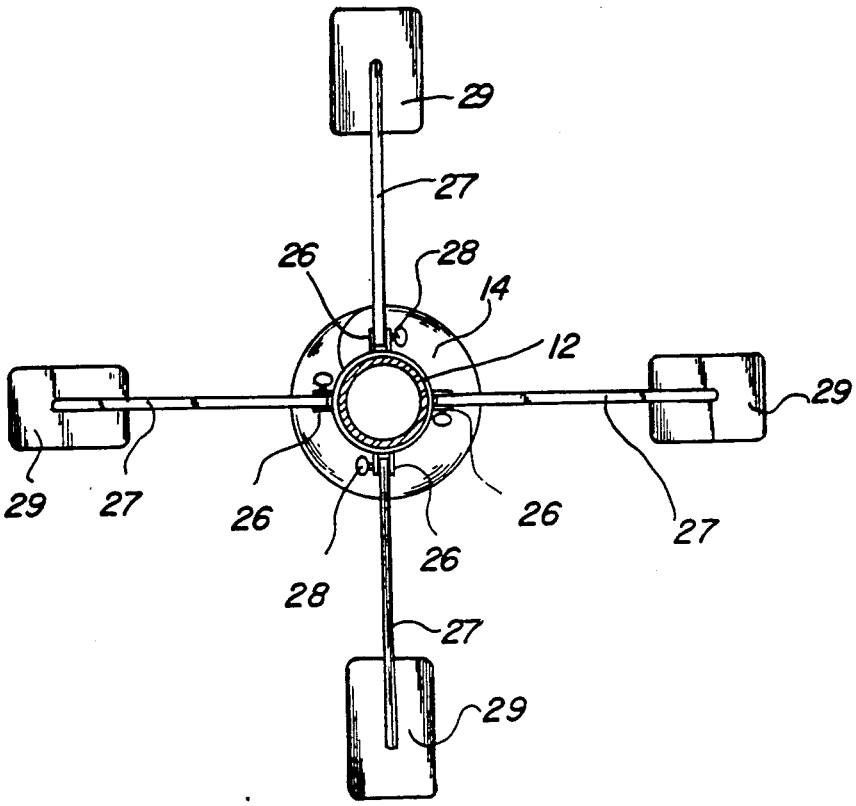
FIG. 6 is an orthographic view, taken along the lines 6—6 of FIG. 5 in the direction indicated by the arrows.

The FIGS. 5 and 6 illustrate the use of a collar 25 mounted about the lower shaft above the outer screw threads 16 and below the lower shaft socket 13. The collar 25 mounts thereabout a plurality of bifurcated collar supports 26 that are spaced apart an equal spacing about the bifurcated collar. Each bifurcated collar support 26 includes a support leg 27 pivotally mounted thereto about an inner distal end of the support leg 27. Each outer distal end of each support leg includes an anchor plate 29 pivotally mounted thereto, with each anchor plate having a matrix of pins 30 orthogonally mounted to a bottom surface of each anchor plate for enhanced engagement and securement of the umbrella structure. The collar supports 26 each includes a collar support fastener 28 about which each inner distal end of each support leg pivots, wherein the fasteners are directed in a manner to clamp the opposed flanges of each bifurcated collar support 26 together to frictionally engage and secure an associated support leg in a predetermined angular orientation relative to the lower shaft 12.

Figure 7:
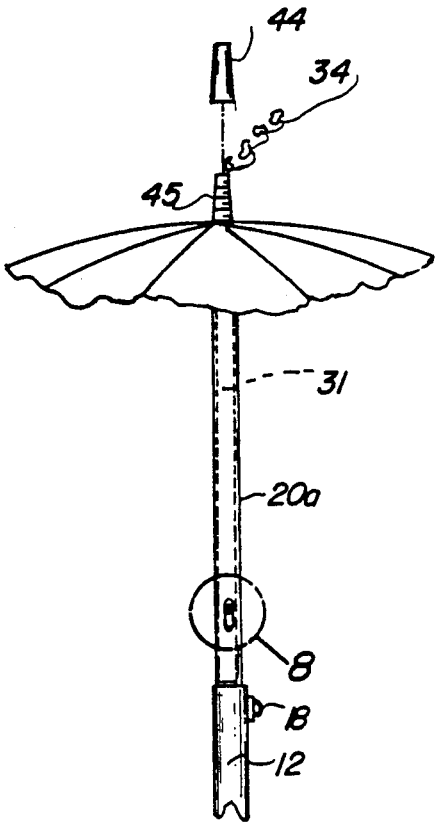
FIG. 7 is an orthographic view of the invention illustrating a tubular upper shaft portion.
Figure 8:
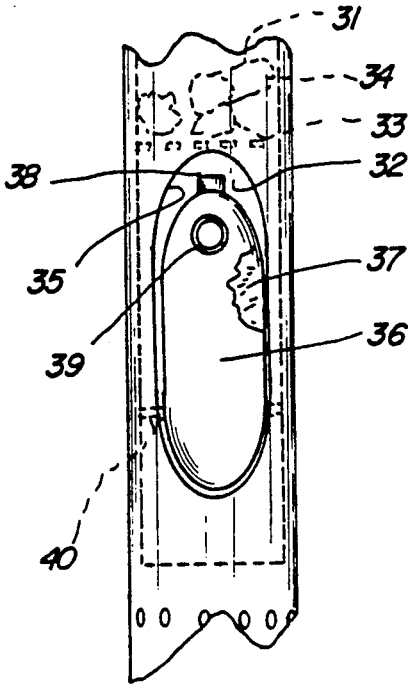
FIG. 8 is an enlarged orthographic view of section 8, as set forth in FIG. 7.
Figure 9:
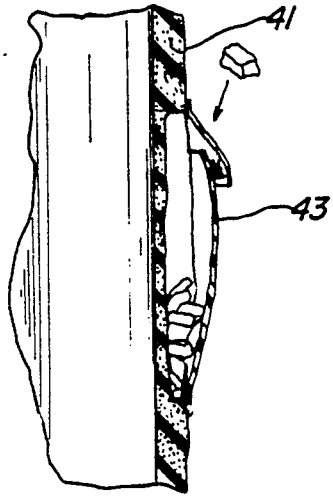
FIG. 9 is a cross-sectional illustration of a sleeve structure utilized by the invention.
Figure 10:
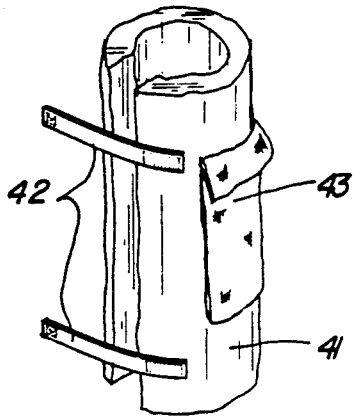
FIG. 10 is an isometric illustration of the sleeve structure, as indicated in FIG. 9 in cross-section.

The FIGS. 7 and 8 illustrate a modified upper shaft 28 having an upper shaft upper cavity 31 extending to an apertured web 33 defining an inner face between the upper shaft upper cavity 31 and an upper shaft lower cavity 32 extending from the apertured web 33 to a lower distal end of the upper shaft 28. The lower cavity 32 includes a lower cavity wall opening 35 directed through the modified upper shaft into the lower cavity 32, with a fluid container 36 pivotally mounted within the lower cavity. The fluid container 36 includes a drinking fluid 37 contained therewithin, with a fluid cap 38 mounted to an upper distal end of the fluid container for selective filling and subsequently sealing of the container, with a fluid release spout 39 mounted adjacent the upper distal end and adjacent the fill cap 38. The fluid release spout 39 upon pivotment of the fluid container about a container axle 40 pivotally mounting the fluid container in the lower cavity permits the release of the fluid 37 through the spout 39. As illustrated in FIG. 7, an upper shaft cap 44 is threadedly removable relative to an externally threaded upper end 45 of the modified upper shaft 20*a* that is positioned above the umbrella canopy. Upon such removal, the upper shaft upper cavity 31 is filled with a dry ice (frozen carbon dioxide) to provide for a refrigeration compartment to direct such refrigerant through the apertured web 33 and maintain chilling of the fluid container 36.

A polymeric flexible sleeve 41 is also provided arranged for selective securement about the beach umbrella 10, and more specifically about the lower shaft 12, the intermediate shaft 17, or the modified shaft 20*a*, with the sleeve 41 having a plurality of fastener strips 42 having hook and loop fastener surfaces for engagement about a fibrous outer covering of the sleeve 41. An insulated pouch 43 is provided to contain various components such as ice and the like for use in dr inking fluids that are received from the fluid container 36.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A beach umbrella, comprising, a lower shaft having a lower shaft socket formed at an upper distal end of the lower shaft, with an outer screw thread formed about the lower shaft adjacent a lower distal end of the lower shaft, with the lower distal end of the lower shaft terminating in a conical projection, and the lower shaft, the lower shaft socket, the lower shaft outer screw, and the lower shaft projection are coaxially aligned, and an intermediate shaft arranged for reception within the lower shaft socket, and the intermediate shaft having an intermediate shaft upper end, and an upper shaft, the upper shaft arranged for reception within the intermediate shaft upper end, with the upper shaft, the intermediate shaft, and the lower shaft coaxially aligned in an assembled configuration, and a first latch pin arranged for projection through the upper shaft and the intermediate shaft, and a second latch pin arranged for projection through the intermediate shaft and the upper shaft to secure the upper shaft, the intermediate shaft, and the lower shaft together, and an umbrella canopy mounted to the upper shaft adjacent an upper end portion of the upper shaft, and the lower shaft socket includes a first handle and a second handle pivotally mounted to the lower shaft socket, with the first handle having a first handle pivot axle and the second handle having a second handle pivot axle, wherein the first handle pivot axle and the second handle pivot axle are longitudinally aligned and diametrically directed on opposed sides of the lower shaft socket, and a collar, the collar having a plurality of bifurcated collar supports mounted to the collar at equally spaced intervals thereabout, with each bifurcated collar including a support leg, each support leg including a support leg inner end pivotally mounted within a respective bifurcated collar support, and each support leg having a support leg outer end, each support leg outer end including an anchor plate pivotally mounted relative to the support leg outer end, each anchor plate having a matrix of pins projecting downwardly relative to a bottom surface of the anchor plate, and each bifurcated collar support including a fastener clamp directed through a respective bifurcated collar support and one of said support legs received within said respective bifurcated collar support to frictionally and angularly secure each support leg relative to the lower shaft, and the upper shaft includes an upper shaft externally threaded upper end above the umbrella canopy, and an upper shaft cap threadedly removable relative to the externally threaded upper end, and an upper shaft upper cavity directed from the upper shaft externally threaded upper end and extending downwardly along the upper shaft to an apertured web, and an upper shaft lower cavity directed form the apertured web to a lower portion of the upper shaft, and the arrangement arranged for reception within the upper shaft cavity, and a fluid container mounted within the lower cavity.

2. An umbrella as set forth in claim 1 wherein the lower cavity includes a lower cavity wall opening directed through the lower shaft in communication with the lower shaft cavity, and the fluid container including a fluid container axle pivotally mounting the fluid container within the lower cavity.

3. An umbrella as set forth in claim 2 wherein the fluid container includes a fill cap removably mounted relative to an upper distal end of the fluid container for refilling the fluid container with a drinking fluid, and a release spout directed into the fluid container adjacent the fill cap oriented at an oblique angle relative to the fill cap to permit release of fluid through the spout upon pivotment of the fluid container about the container axle.

4. An umbrella as set forth in claim 3 including a polymeric flexible sleeve arranged for selective securement about one of said lower shaft, intermediate shaft, and upper shaft, with the flexible sleeve having an insulated pouch mounted to an outer surface thereof for containment of iced components therewithin.

* * * * *